US005261493A

United States Patent [19]

Brammer

[11] Patent Number: 5,261,493

[45] Date of Patent: Nov. 16, 1993

[54] METHOD OF TESTING SNAP TYPE PIPE CONNECTORS

[75] Inventor: Ashley N. M. Brammer, Fyvie, Scotland

[73] Assignee: ABB Vetco Gray Inc., Houston, Tex.

[21] Appl. No.: 909,271

[22] Filed: Jul. 6, 1992

[51] Int. Cl.[5] ..... E21B 19/16; F16L 35/00

[52] U.S. Cl. ..... 166/378; 166/85; 405/170; 285/921

[58] Field of Search ..... 166/336, 377, 378, 77.5, 166/85; 175/423; 405/170; 285/921, 922, 333

[56] References Cited

U.S. PATENT DOCUMENTS 4,124,231 11/1978 Ahlstone ..... 285/381 X
4,298,221 11/1981 McGugan ..... 285/381 X
4,526,408 7/1985 Anderson ..... 285/47
4,601,491 7/1986 Bell, Jr. et al. ..... 285/24

*Primary Examiner*—Terry Lee Melius
*Attorney, Agent, or Firm*—James E. Bradley

[57] ABSTRACT

A method of testing snap type pipe connectors utilizes the same clamp that is used to clamp the pipe connectors together. The connectors are a part of pipe sections, with each connector having a profile that radially interferes with the other so that under straight axial compression, the connectors are snapped together. The clamp tool that applies compressive force will be reversed after the compressive force has been applied to apply a tensile test force. The test force is greater than the compressive force required to snap the pipe connectors together.

7 Claims, 2 Drawing Sheets

METHOD OF TESTING SNAP TYPE PIPE CONNECTORS

BACKGROUND OF THE INVENTION

1. Field of the invention

This invention relates in general to connectors for pipe of large diameter used in offshore drilling operations, and in particular to a method for testing pipe connectors of a snap type which connect together by a straight compressive force.

2. Description of the Prior Art

During initial stages of drilling an offshore subsea well, large diameter pipe will be used for various purposes, such as risers and conductor pipe. The pipe may be 20–30 inches in diameter, with each section being about 40 feet long. The connectors between each pipe section must handle high tensile forces, and also be able to accommodate bending moments. Making up the joints is difficult, particularly on floating vessels which have wave motion, currents and wind.

U.S. Pat. No. 4,601,491, Jul. 22, 1986, James L. Bell, Jr., et al., discloses a connector that has mating conical profiles formed in box and pin members. The profile utilizes a thread form with grooves and crests which stab straight inward under compressive force. During insertion, the profiles of the box and pin will interfere with each other radially in an intermediate position until sufficient compressive force is applied to overcome the frictional force due to the radial interference. Once this is overcome, the crests will snap into the grooves, forming the connected position. Radial interference exists in the connected position, also, however to a lesser degree than in the intermediate position.

The apparatus for snapping the pipe connectors together is a large clamp tool. The clamp has an upper clamp ring that engages an external groove on one connector, and a lower clamp ring that engages an external groove on the other connector. Hydraulic cylinders extend between the upper and lower rings. When actuated, the hydraulic cylinders will pull the rings toward each other to exert the compressive force to make the connection.

Once the connectors appear visually to have snapped into the locked position, the clamp rings are radially retracted and the sections of pipe lowered until the next connector is reached. In the prior art, checks are made to ensure that the gap between the two external faces of the connectors is less than a specified dimension. Also, the circumference of the box connector is measured before and after makeup. This provides an indication as to the state of the makeup.

SUMMARY OF THE INVENTION

In this invention, a method is employed for field testing the connection after the connectors appear to have snapped into place. This is handled by utilizing the same clamp that clamps the upper and lower pipe connectors together. After sufficient compressive force has been applied to snap the members together, the operator will apply hydraulic pressure to the opposite sides of the hydraulic cylinders. This causes the clamp rings to tend to move axially apart from each other, exerting a test force on the connectors. The amount of test force is preferably greater than the predetermined amount of pull-out force that would be required to pull the connectors apart if the profiles were still in an intermediate position and not yet in the connected position.

During the test, if the connectors pull apart from each other, then this indicates that the connectors were not properly connected. The test force applied to the connectors is not sufficient to cause damage to the profiles if the profiles are fully connected with each other.

DETAILED DESCRIPTION OF THE INVENTION

Figure 1:
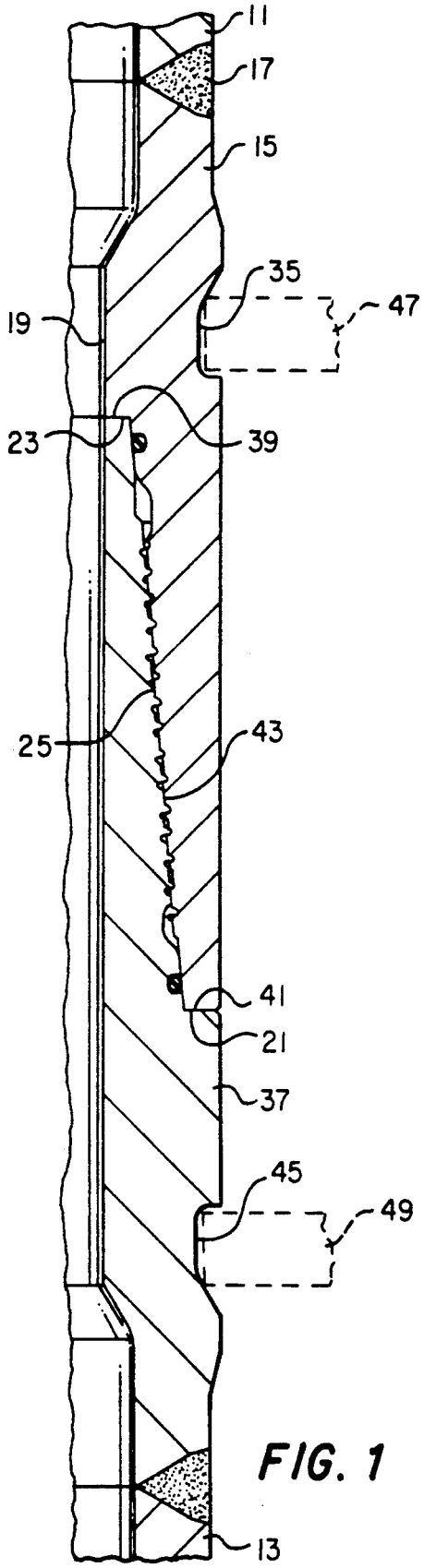
FIG. 1 is a quarter sectional view illustrating mating pipe connectors of a type on which the method of this invention will be utilized.

Referring to FIG. 1, an upper pipe section 11 is shown connected to a lower pipe section 13. Each pipe section 11, 13 is of a diameter in the range of 20–30 inches and having a length of about 40 feet. The upper pipe section 11 has a connector box 15 on its lower end secured by a weld 17. Box 15 has an axial bore 19 terminating in a rim 21 at the lower end. A counterbore shoulder 23 locates in bore 19. A conical profile 25 is located between counterbore shoulder 23 and rim 21.

Figure 2:
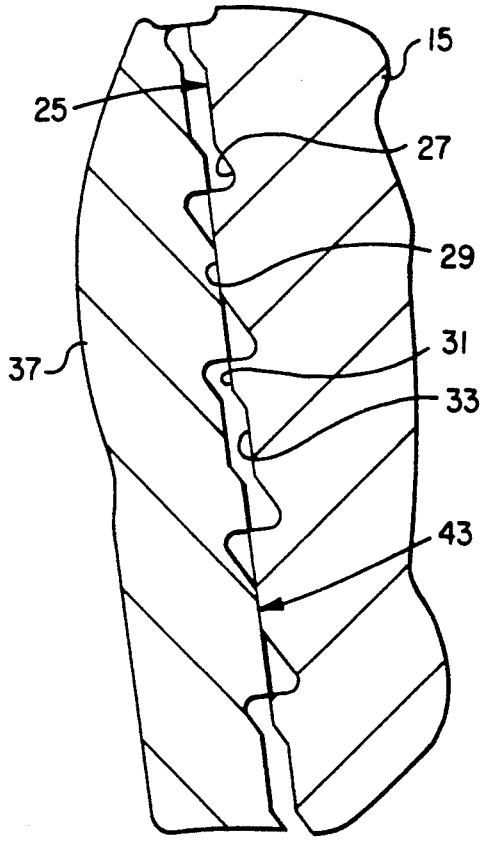
FIG. 2 is an enlarged view of the connectors of FIG. 1, showing the profiles in an intermediate position.

Referring to FIG. 2, the profile 25 is of a type described in U.S. Pat. No. 4,601,491, Issued Jul. 22, 1986, James L. Bell, et al., all of which material is hereby incorporated by reference. Profile 25 will secure with a straight axial force, yet can be rotated to unscrew it if desired. Profile 25 has a conical surface with a thread-form comprising a plurality of grooves 27 which are evenly spaced apart from each other axially. Profile 25 includes wide crests 29 which alternate with narrow crests 31. One of the crests 29, 31 will be located between each of the grooves 27. A crest recess 33 extends adjacent each narrow crest 31. Wide crests 29 and narrow crests 31 are located on the same conical surface of revolution. Box 15 has an external groove 35 on the exterior for use in making up the pipe sections 11, 13.

Box 15 mates with a pin 37. Pin 37 has a nose 39 on its upper end that will abut counterbore shoulder 23 when made up. Pin 37 has an external shoulder 41 on its end that will be in substantial abutment with rim 21 when made up. A pin profile 43 locates on the exterior of pin 37 between shoulder 41 and nose 39. Pin profile 43 is conical and is configured the same as box profile 25 for making up with box profile 25.

Referring to FIG. 2, the crests 29, 31 of each profile 25, 43 are sized to radially interfere with each other, both during insertion and when fully connected. During insertion, in an intermediate position, the crests 29, 31 of the box profile 25 will engage the crests 29, 31 of the pin profile 43, as shown in FIG. 2. Elastic radial deformation of the profiles 25, 43 occurs when in the intermediate position. With enough compressive force, the crests 29, 31 will pass each other and enter the fully connected position shown in FIG. 3. In the connected position, narrow crests 31 will enter grooves 27. Each crest recess 33 will engage in radial interference a wide crest 29 in the connected position. The amount of radial interference is not as high as when narrow crests 31 of profile 25 engage narrow crests 31 of profile 43 in the intermediate position.

Large fictional forces are encountered when forcing the profiles 25, 43 together. This frictional force can be calculated for a given pipe configuration, so as to provide an operator with a theoretical compressive force required to move past the intermediate position shown in FIG. 2 to the connected position shown in FIG. 3. This minimum compressive force required also represents a theoretical maximum pull-out force that would be required to pull apart the profiles 25, 43 while they are in the intermediate position of FIG. 2.

For example, in 26 inch diameter connectors of a type shown in FIG. 1, the following calculations have been made. The diameter of the pin profile 43 at the uppermost of the crests 29, 31 is 24.076 inch. The diameter of the box profile 25 at the lowermost of the crests 29, 31 is 25.108 inch. The thread cone angle is 4 degrees. The engaged length of the profiles 25, 43 is 7.940 inch. The change in thread diameter over the engaged length is approximately two times 7.940 times the sine of 4 degrees, equalling 1.108 inch. The maximum radial interference is 24.0076 inch plus 1.108 inch less 25.108 inch, equalling 0.076 inch. Adding tolerances of 0.006 inch for maximum metal conditions results in a maximum radial interference at the intermediate position of FIG. 2 of 0.082 inch.

Figure 3:
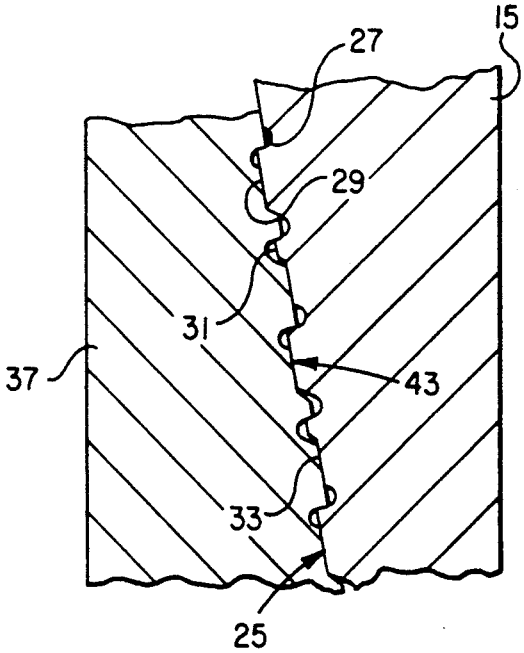
FIG. 3 is an enlarged view of a portion of the connectors of FIG. 1, showing the profiles in fully connected position.

The radial interference when the profiles 25, 43 are fully connected as in FIG. 3 is known to be 0.013 inch, or 0.026 inch on a diameter. Conventional static and fatigue analysis of this type of connection can be calculated to show that the radial force exerted by the interference of profiles 25, 43 at the fully connected position with a diametric interference of 0.026 inch is 417,830 pounds. Assuming that the radial force is linear with interference, while in the intermediate position of FIG. 2, the radial force would be 417,830 pounds times 0.082 inch interference divided by 0.026 inch interference, resulting in 1,318,000 pounds. Assuming a coefficient of friction of 0.09 for lubricated smooth surfaces, and neglecting taper angle, the maximum frictional force to move the profiles 25, 43 axially in either direction from that shown in intermediate position of FIG. 2 would be 1,316,000 pounds times 0.09 or 118,600 pounds. This amount of force is required to either pull them apart from the intermediate position shown in FIG. 2 or to push them to the connected position shown in FIG. 3.

In the method of this invention, after sufficient compressive force has been applied to place them in the fully connected position of FIG. 3, the operator will then apply a tensile force tending to pull the profiles 25, 43 apart from each other. This test force is selected to be greater than the minimum compressive force required to move the profiles 25, 43 from the intermediate position of FIG. 2 to the fully connected position of FIG. 3. The minimum compressive force is the same as the pull-out force that would be required to pull them apart if the connectors were believed to be in the fully connected position, but in fact were still in an intermediate position. Preferably, this test force is almost double that of the calculated minimum pull-out force, but far below the tensile capacity of the profiles 25, 43, when fully connected, which in the example described, is four million pounds. Using the clamp shown in FIGS. 4 and 5 in one particular embodiment will yield a test force of 218,200 pounds.

Figure 4:
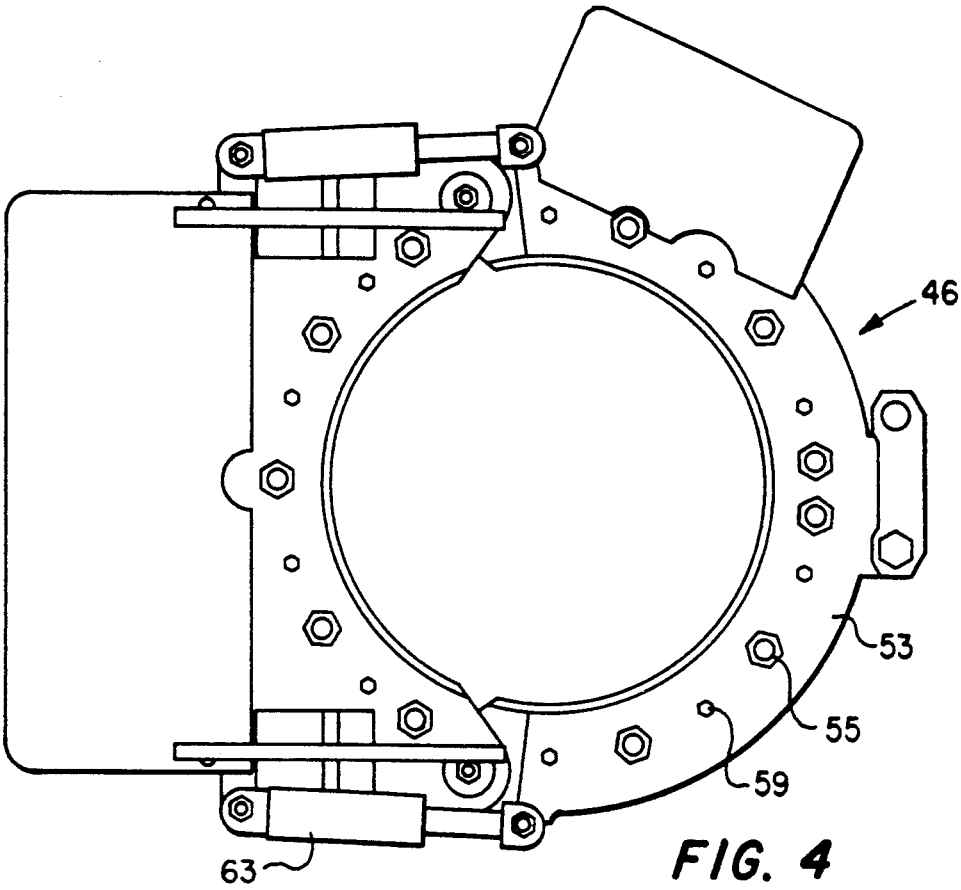
FIG. 4 is a top view of a clamp tool for use with the method of this invention.
Figure 5:
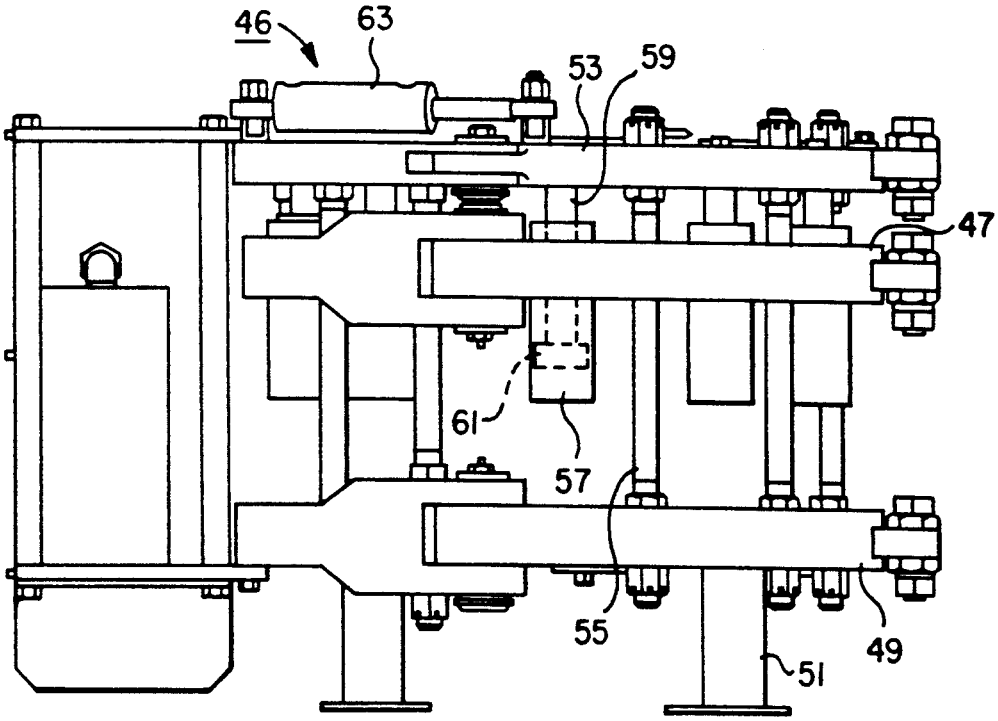
FIG. 5 is a side view of the clamp tool of FIG. 4.

Referring to FIGS. 4 and 5, the clamp 46 is basically a conventional commercially available apparatus, with minor modifications. It has an upper clamp ring 47 and a lower clamp ring 49, each of which is formed in two halves. Upper clamp ring 47 is adapted to engage box external groove 35, while lower clamp ring 49 is adapted to engage pin external groove 45. In the embodiment shown, lower clamp ring 49 is mounted to a lower frame 51 which will fit on the platform of the drilling vessel.

An upper frame 53, which also is in two halves, extends upward from lower frame 51. Lower clamp ring 49, lower frame 51, and upper frame 53 will not move in axial directions relative to the platform. A plurality of guide rods 55 extend between the lower clamp ring 49 and upper frame 53. Upper clamp ring 47 will move slidingly up and down the guide rods 55. Upper clamp ring 47 will thus move toward and away from lower clamp ring 49.

A plurality of hydraulic cylinders 57 are spaced around upper clamp ring 47. The cylindrical sleeve portion of each hydraulic cylinder 57 mounts rigidly to upper clamp ring 47. A piston rod 59 extends upward from each hydraulic cylinder 57 and secures rigidly to upper frame 53. As shown by the dotted lines in FIG. 5, a piston 61 locates slidingly within each hydraulic cylinder 57. When supplied with hydraulic fluid pressure on its lower side, piston rod 59 will extend, moving upper clamp ring 47 downward toward lower clamp ring 49. As shown in FIG. 4, a pair of retract cylinders 63 move the halves of upper frame 53, upper clamp ring 47, and lower clamp ring 49 from a larger diameter to a smaller diameter to extend into and retract outward from the grooves 35, 45 (FIG. 1).

In the prior commercial version of clamp 46, air pressure was used to move upper clamp ring 47 back upward relative to lower clamp ring 49. In this invention, a valve (not shown) is employed to apply hydraulic pressure in reverse to the hydraulic cylinders 57 to cause upper clamp ring 47 to tend to move back upward from lower clamp ring 49. When hydraulic fluid pressure is supplied to hydraulic cylinders 57 above pistons 61, hydraulic cylinders 57 will tend to retract, tending to cause upper clamp ring 47 to move upward from lower clamp ring 49.

If supplied with hydraulic pressure to the upper sides of pistons 61, a commercially available version of clamp 46 will exert a tensile test force sufficient to exceed the calculated compressive force required to snap the box 15 to the pin 37. In one version, the diameter of piston 61 on the lower side is 4.988 square inches and the cross-sectional area of piston rod 59 is 2.086 square inches. Consequently, when hydraulic pressure is applied above piston 61, the effective piston area will be 4.98 square inches minus 2.806 square inches, or 2.182 square inches.

The preferred hydraulic pump for clamp 46 has a maximum pressure of 10,000 pounds per square inch, yielding a compressive or clamping force per hydraulic cylinder 57 of 10,000 pounds per square inch times 4.988 square inch, or 49,880 pounds. The test force per cylinder 57 is 10,000 pounds per square inch times 2.182 square inches, or 21,820 pounds. Preferably there are ten hydraulic cylinders 57. As a result, this provides an overall clamping force availability of 498,800 pounds. It provides a test force availability of 218,200 pounds. As previously mentioned, the maximum pull-out force from the intermediate position of FIG. 2 is calculated to be 118,600 pounds. Therefore, using the return or retracting side of piston 61 for test purposes will yield a test force that exceeds the maximum calculated pull-out force during the intermediate position of approximately 100,000 pounds. Also, the test force of 218,200 pounds is far less than the maximum tensile strength of the profiles 25, 43, when connected, so as to avoid any possibility of damage to the profiles 25, 43 during the test.

In operation, the operator will locate the clamp 46 on the platform floor. The operator will lower a first pipe section 13 and suspend the pipe section 13 with slips (not shown) with its pin 37 at the rig floor. The operator will lower the box 15 of an upper pipe section over the pin 37 of the lower pipe section 13. Alternately, the pin 37 could be lowered into an upward facing box 15. The operator will actuate the cylinders 63 to cause the clamp rings 47, 49 to engage the grooves 35, 45, respectively.

The operator then supplies hydraulic fluid pressure to the lower sides of pistons 61 of hydraulic cylinders 57 to cause hydraulic cylinders 57 to extend. The upper clamp ring 47 will downward toward the lower clamp ring 49. The profiles 25, 43 will move into the intermediate position of maximum radial interference between crests 31 of each profile 25, 43, as shown in FIG. 2. The profiles 25, 43 will then move into the fully connected position shown in FIG. 3. In the fully connected position, the narrow crests 31 will engage the grooves 27. There will still be radial interference at this point due to engagement of the crest recesses 33 with the wide crests 29, however much less than in the intermediate position.

The operator will then supply hydraulic fluid pressure to the hydraulic cylinders 57 above pistons 61. Pistons 61 will tend to cause hydraulic cylinders 57 to move upward, exerting a tensile force on profiles 25, 43. As the clamp rings 47, 49 tend to move apart from each other, they will tend to pull the box 15 from the pin 37. This test force will be approximately 100,000 pounds more than the compressive force required to move from the intermediate position of FIG. 2 to the fully connected position of FIG. 3. If after a few moments, box 15 does not pull upward from pin 37, then the operator can assume that the connection is good.

The operator will then release the hydraulic pressure in hydraulic cylinders 57. The operator actuates retract cylinders 63 to move the upper and lower rings 47, 49 from the grooves 35, 45. The operator then lowers the connected upper and lower pipe sections 11, 13, and supports the pin 37 of the upper section 11 at the rig floor. The operator will then repeat the clamping and testing process until the entire string is made up and tested.

The invention has significant advantages. By applying a tensile force to the connection after it is snapped together, the operator will be assured that the connector moves to the fully connected position from the intermediate position. The test requires no additional equipment and very little extra time. By using the clamp tool, the test can become part of the makeup operation.

While the invention has been shown in only one of its forms, it should be apparent to those skilled in the art that it is not so limited, but is susceptible to various changes without departing from the scope of the invention.

I claim:

1. A method of connecting a string of pipe together on an offshore platform for a subsea well, the string of pipe having a plurality of pipe sections, each pipe section having upper and lower connectors on each end which are configured to snap together with adjacent pipe sections under straight axial compression, the method comprising:

(a) supporting a first pipe section of the string of pipe with the upper connector of the first pipe section at the platform;

(b) inserting the lower connector of a second pipe section into contact with the upper connector of the first pipe section; then (c) applying at the platform a straight axial compressive force to the upper and lower connectors in an amount sufficient to cause the upper and lower connectors to snap together; then (d) applying at the platform a test force of straight axial tensile force to the connectors tending to pull the connectors apart from each other in an amount sufficient to determine that the connectors have properly snapped together; then lowering the first and second pipe sections from the platform.

2. The method according to claim 1 wherein the amount of the test force applied is greater than the amount of the compressive force required to snap the connectors together.

3. The method according to claim 1 wherein step (c) is performed by providing a clamp and operating the clamp in a clamping mode, and wherein step (d) is performed by operating the clamp in a reversed mode to the clamping mode.

4. The method according to claim 1 wherein step (c) is performed by:

providing a clamp having upper and lower clamping rings and hydraulic cylinders connected between the clamping rings;

engaging the clamping rings with the upper and lower connectors; then actuating the hydraulic cylinders in a clamping mode to move the clamping rings toward each other; and wherein step (d) is performed by actuating the hydraulic cylinders in a reversed mode to tend to move the clamping rings apart from each other.

5. A method of connecting a string of pipe together on an offshore platform for a subsea well, the string of pipe having a plurality of pipe sections, each pipe section having upper and lower connectors on each end, each of the connectors having a plurality of grooves and crests defining a profile which is configured to connect to a mating profile of the connector of an adjacent pipe section under straight axial compression, the profiles having an intermediate position of maximum radial interference and a connected position, requiring a compressive force to move the profiles past the intermediate position to the connected position, the method comprising:

(a) providing a clamp having upper and lower clamping rings and hydraulic cylinders connected between the clamping rings;

(b) supporting one of the pipe sections at the platform;

(c) inserting the lower connector of another of the pipe sections into engagement with the upper connector of the pipe section supported at the platform;

(d) engaging the clamping rings with the upper and lower connectors; then (e) actuating the hydraulic cylinders to move the clamping rings toward each other with a compressive force sufficient to move the profiles to the connected position; then (f) actuating the hydraulic cylinders in a direction opposite to that of step (e) to tend to move the clamping rings apart from each other, applying a tensile test force in an amount sufficient to determine that the profiles of the upper and lower connectors have entered the connected position.

6. The method according to claim 5, wherein the tensile test force applied in step (f) is greater than the compressive force applied in step (e).

7. In a method of connecting a string of pipe together on an offshore platform for a subsea well, the string of pipe having a plurality of pipe sections, each pipe section having upper and lower connectors on each end, each of the connectors having a plurality of grooves and crests defining a profile which is configured to connect to a mating profile of the connector of an adjacent pipe section under straight axial compression, the profiles having an intermediate position during insertion of maximum radial interference and a connected position when insertion is completed of lesser radial interference, the method including providing a clamp having upper and lower clamping rings and hydraulic cylinders connected between the clamping rings, engaging the clamping rings with the upper and lower connectors which have been inserted together, and actuating the hydraulic cylinders in a compressive mode to move the clamping rings toward each other with a compressive force sufficient to move the profiles of the upper and lower connectors past the intermediate position to the connected position, the improvement comprising;

determining an amount of a pull-out force required to pull the profiles apart from each other if the profiles have entered the intermediate position, but not fully entered the connected position; then, after the hydraulic cylinders have been actuated in a compressive mode, .

actuating the hydraulic cylinders in a direction opposite to the compressive mode to tend to move the clamping rings apart from each other, applying a tensile test force in an amount greater than the pull-out force to determine whether the profiles of the upper and lower connectors have entered the connected position.

* * * * *